US007841451B2

(12) United States Patent
Ito

(10) Patent No.: US 7,841,451 B2
(45) Date of Patent: Nov. 30, 2010

(54) NON-CONTACT RUNNING TYPE ELEVATOR

(75) Inventor: Hiroaki Ito, Tokyo (JP)

(73) Assignee: Toshiba Elevator Kabushiki Kaisha, Tokyo (JP)

( * ) Notice: Subject to any disclaimer, the term of this patent is extended or adjusted under 35 U.S.C. 154(b) by 123 days.

(21) Appl. No.: 12/360,423

(22) Filed: Jan. 27, 2009

(65) Prior Publication Data

US 2009/0133970 A1 May 28, 2009

Related U.S. Application Data

(63) Continuation of application No. PCT/JP2007/067137, filed on Sep. 3, 2007.

(30) Foreign Application Priority Data

Sep. 6, 2006 (JP) ..... 2006-241708

(51) Int. Cl.
*B66B 1/34* (2006.01)

(52) U.S. Cl. ..... 187/292; 187/409; 187/393

(58) Field of Classification Search ..... 187/277, 187/292, 293, 296, 297, 391–393, 289, 401, 187/409, 410; 318/799–815
See application file for complete search history.

(56) References Cited

U.S. PATENT DOCUMENTS 5,308,938 A * 5/1994 Roberts et al. ..... 187/393
5,749,444 A * 5/1998 Skalski ..... 187/409
6,338,396 B1 1/2002 Morishita
6,401,872 B1 * 6/2002 Morishita ..... 187/292
6,408,987 B2 6/2002 Morishita
7,014,013 B2 * 3/2006 Fujita ..... 187/292
7,314,119 B2 * 1/2008 Husmann et al. ..... 187/292
2008/0110701 A1 5/2008 Ito et al.

FOREIGN PATENT DOCUMENTS

| | | | |
|---|---|---|---|
| JP | 5-178563 | A | 7/1993 |
| JP | 7-002457 | A | 1/1995 |
| JP | 7-196273 | A | 8/1995 |
| JP | 10-218512 | A | 8/1998 |
| JP | 2001-019286 | A | 1/2001 |
| JP | 2001-171919 | A | 6/2001 |
| JP | 2001-261260 | A | 9/2001 |
| JP | 2006-188316 | A | 7/2006 |

* cited by examiner

*Primary Examiner*—Jonathan Salata
(74) *Attorney, Agent, or Firm*—Foley & Lardner LLP

(57) ABSTRACT

In an elevator including a guide apparatus which levitates the car from a guide rail by an effect of magnetic force and non-contactly runs and guides the car, the guide apparatus is controlled in a manner to generate magnetic force with respect to at least two of movement axes of the car. In this case, control is executed with respect to only some of the movement axes at a time of start of guide, and then control is executed with respect to the other movement axes after passing of a predetermined time from the start of the guide.

24 Claims, 16 Drawing Sheets

NON-CONTACT RUNNING TYPE ELEVATOR

CROSS REFERENCE TO RELATED APPLICATIONS

This is a Continuation Application of PCT Application No. PCT/JP2007/067137, filed Sep. 3, 2007, which was published under PCT Article 21(2) in Japanese.

This application is based upon and claims the benefit of priority from prior Japanese Patent Application No. 2006-241708, filed Sep. 6, 2006, the entire contents of which are incorporated herein by reference.

BACKGROUND OF THE INVENTION

1. Field of the Invention

The present invention relates to a non-contact running type elevator in which a car is run in non-contact with guide rails.

2. Description of the Related Art

In general, a car of an elevator is supported on a pair of guide rails which are vertically disposed in the elevation path, and the car is elevated by ropes which are wounded around a hoister. At this time, shaking of the car, which occurs due to imbalance of the load weight or movement of passengers, is suppressed by the guide rails.

As a guide apparatus for guiding the car, use is made of roller guides comprising wheels, which are in contact with the guide rails, and suspensions, or guide shoes which slide over the guide rails and guide the car. In this contact-type guide apparatus, however, vibration or noise occurs due to misalignment of guide rails or joints of the guide rails. In addition, noise occurs when the roller guides rotate. Thus, there occurs a problem that the comfortablility of the elevator deteriorates.

In order to solve this problem, there has conventionally been proposed a method of non-contactly guiding the car, for example, as disclosed in Patent Documents 1 and 2.

In Patent Document 1, a guide apparatus comprising electromagnets is mounted on the car, and magnetic force is caused to act on iron-made guide rails, thereby non-contactly guiding the car.

Patent Document 2 discloses the use of permanent magnets in order to solve problems, such as a decrease in controllability and an increase in power consumption, which occur in the structure using the electromagnets.

Patent Document 1: Jpn. Pat. Appln. KOKAI Publication No. H5-178563; and

Patent Document 2: Jpn. Pat. Appln. KOKAI Publication No. 2001-19286.

BRIEF SUMMARY OF THE INVENTION

In usual cases, the above-described non-contact type guide apparatuses are configured such that the magnetic force is controlled according to predetermined control rules, thereby non-contactly guiding the running of the car.

When the car is in a stable non-contact state (levitation state), the power that is needed for guiding is relatively small. However, when the car begins to separate and levitate from the guide rail (guide start time), a relatively high power is instantaneously needed. It is thus necessary to prepare a power supply capacity of the guide apparatus in accordance with the necessary power at the guide start time.

The object of the present invention is to provide a non-contact running type elevator which can non-contactly run a car with a minimum possible power supply capacity, while suppressing a maximum power that is needed at the guide start time of the car.

According to an aspect of the present invention, there is provided a non-contact running type elevator comprising: a guide rail which is laid in an up-and-down direction in an elevation path; a car which ascends and descends along the guide rail; a guide apparatus which is disposed on a part of the car, which is opposed to the guide rail, the guide apparatus levitating the car from the guide rail by an effect of magnetic force, and non-contactly running and guiding the car; and a control device which controls the guide apparatus in a manner to generate magnetic force with respect to at least two movement axes of the car, the control device executing control for only some of the movement axes at a time of start of guide, and then executing control for the other movement axes after passing of a predetermined time from the start of the guide.

According to another aspect of the present invention, there is provided a non-contact running type elevator comprising: a guide rail which is laid in an up-and-down direction in an elevation path; a car which ascends and descends along the guide rail; a guide apparatus which is disposed on a part of the car, which is opposed to the guide rail, the guide apparatus levitating the car from the guide rail by an effect of magnetic force, and non-contactly running and guiding the car; and a control device which controls the guide apparatus in a manner to generate magnetic force with respect to at least two movement axes of the car, the control device having control gains which are set for the respective movement axes, executing control, with respect to a specified one of the movement axes, with control gains for generating the magnetic force that is necessary for guiding from beginning of the guiding, executing control, with respect to the other movement axes, with control gains lower than the control gains for generating the magnetic force that is necessary for guiding from beginning of the guiding, and executing control with a predetermined control gain with respect to each of the movement axes after passing of a predetermined time from the beginning of the guiding.

According to still another aspect of the present invention, there is provided a non-contact running type elevator comprising: a guide rail which is laid in an up-and-down direction in an elevation path; a car which ascends and descends along the guide rail; a guide apparatus which is disposed on a part of the car, which is opposed to the guide rail, the guide apparatus levitating the car from the guide rail by an effect of magnetic force, and non-contactly running and guiding the car; and a control device which controls the guide apparatus in a manner to generate magnetic force with respect to at least two movement axes of the car, the control device having control gains which are set for the respective movement axes, executing control with control gains for guiding in a normal state when guide positions relating to the respective movement axes are within a predetermined range, and executing control with control gains which are different from the control gains for guiding in the normal state with respect to some or all of the movement axes when the guide positions are out of the predetermined range.

According to still another aspect of the present invention, there is provided a non-contact running type elevator comprising: a guide rail which is laid in an up-and-down direction in an elevation path; a car which ascends and descends along the guide rail; a guide apparatus which is disposed on a part of the car, which is opposed to the guide rail, the guide apparatus levitating the car from the guide rail by an action of magnetic force, and non-contactly running and guiding the car; and a control device which controls the guide apparatus in a manner to generate magnetic force with respect to at least two movement axes of the car, the control device having at least two kinds of control gains which are set for the respective movement axes, and executing control by switching the control gains in accordance with a state of each of the movement axes.

DETAILED DESCRIPTION OF THE INVENTION

Embodiments of the present invention will now be described with reference to the accompanying drawings.

First Embodiment

Figure 1:
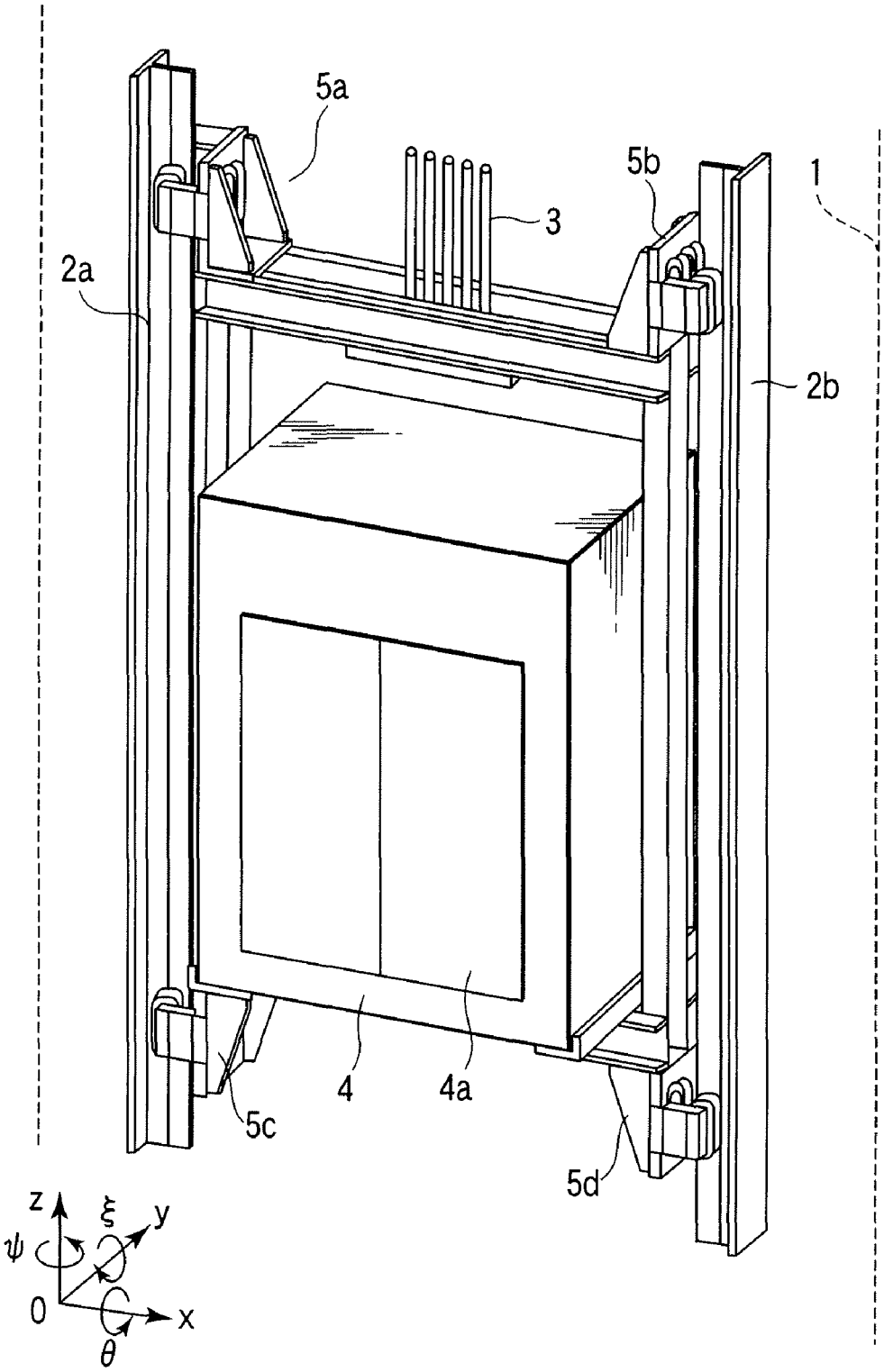
FIG. 1 is a perspective view in a case where a non-contact guide apparatus according to a first embodiment of the present invention is applied to a car of an elevator.

FIG. 1 is a perspective view in a case where a non-contact guide apparatus according to a first embodiment of the present invention is applied to a car of an elevator.

As is shown in FIG. 1, a pair of guide rails 2*a* and 2*b*, which are formed of iron-made ferromagnetic bodies, are erectingly provided in an elevation path 1 of the elevator. A car 4 is suspended by ropes 3 which are wound around a hoister (not shown). With the rotation of the hoister, the car 4 is elevated along the guide rails 2*a* and 2*b*. Reference numeral 4*a* denotes a car door. The car door 4*a* is opened/closed when the car 4 arrives at each floor.

It is assumed that when the car door 4*a* of the car 4 is viewed in the frontal direction, the right-and-left direction of the car door 4*a* is an x axis, the back-and-forth direction is a y axis, and the up-and-down direction is a z axis. The rotational directions about the x axis, y axis and z axis are denoted by $\theta$, $\xi$ and $\phi$.

Guide apparatuses 5*a*, 5*b*, 5*c* and 5*d* are attached to coupling parts at four corners of the car 4, namely, upward, downward, leftward and rightward corners of the car 4, in a manner to face the guide rails 2*a* and 2*b*. As will be described later, by controlling the magnetic force of the guide apparatuses 5*a*, 5*b*, 5*c* and 5*d*, the car 4 levitates from the guide rails 2*a* and 2*b* and runs non-contactly.

The control of the magnetic force is executed with respect to five of the six movement axes (x, y, z, $\theta$, $\xi$ and $\phi$) shown in FIG. 1, except the z axis. The z axis is excluded since the car 4 is supported by the ropes 3 in the z axis, and the z axis has no relation to the levitation.

Figure 2:
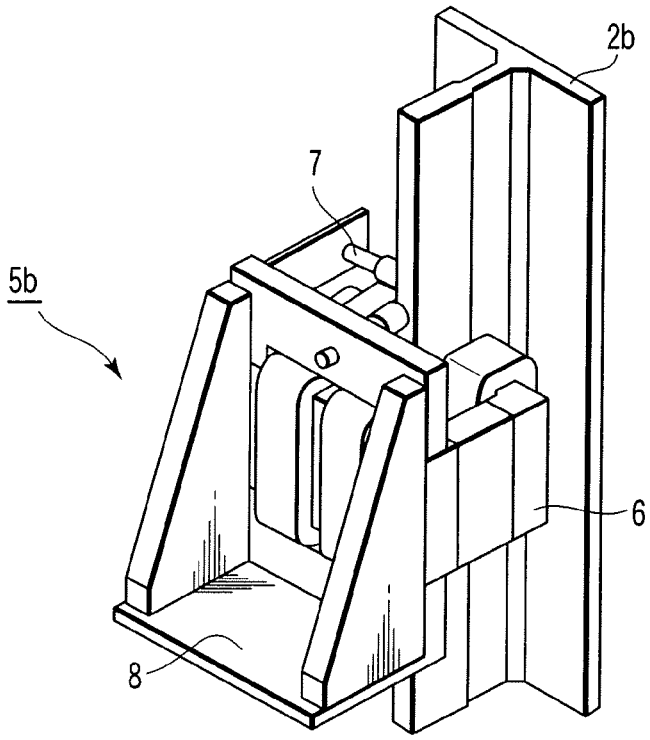
FIG. 2 is a perspective view showing the structure of the non-contact guide apparatus according to the first embodiment of the invention.

FIG. 2 shows the structure of the magnetic guide apparatus 5*b*, as a representative example, which is attached to the upper part of the right-side guide rail 2*b* in FIG. 2.

The guide apparatus 5*b* comprises a magnet unit 6, gap sensors 7 which detect the distance between the magnet unit 6 and the guide rail 2*a*, 2*b*, and a base 8 which supports the magnet unit 6 and gap sensors 7. The other guide apparatuses 5*a*, 5*c* and 5*d* have the same structure.

Figure 3:
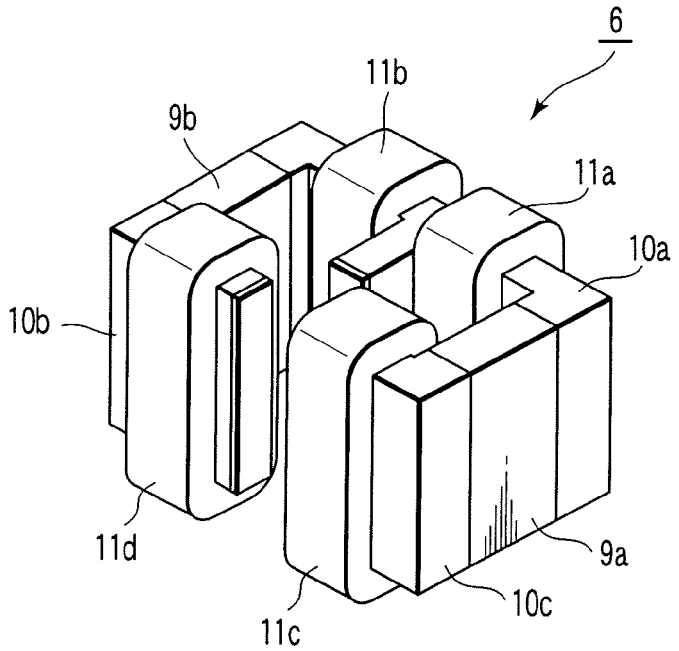
FIG. 3 is a perspective view showing the structure of a magnet unit of the non-contact guide apparatus according to the first embodiment of the invention.

As shown in FIG. 3, the magnet unit 6 comprises permanent magnets 9*a* and 9*b*, yokes 10*a*, 10*b* and 10*c*, and coils 11*a*, 11*b*, 11*c* and 11*d*. The yokes 10*a*, 10*b* and 10*c* have their magnetic poles opposed to the guide rail 2*a*, 2*b* in such a manner as to surround the guide rail 2*a*, 2*b* in three directions. The coils 11*a*, 11*b*, 11*c* and 11*d* are wound around the yokes 10*a*, 10*b* and 10*c* functioning as iron cores, thus constituting electromagnets whose magnetic fluxes at magnetic pole portions can be controlled.

With the above-described structure, the coils 11 are excited on the basis of the quantity of state in a magnetic circuit, which is detected by the gap sensors 7, etc. Thus, the guide rail 2*a*, 2*b* and the magnet unit 6 are spaced apart by the magnetic force that is generated, and the car 4 can be run and guided non-contactly.

(Structure of Control Device)

Figure 4:
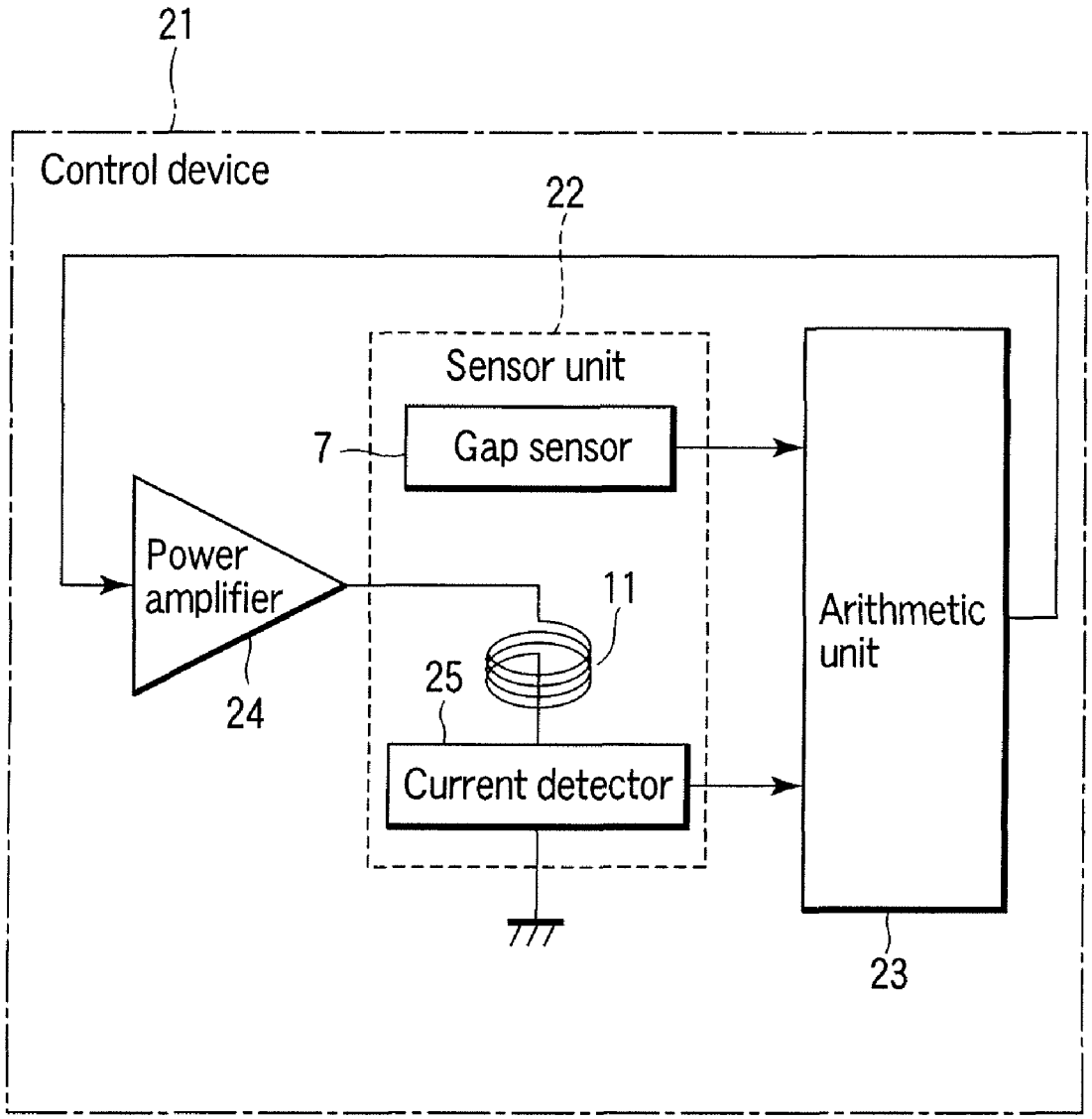
FIG. 4 is a block diagram showing the structure of a control device for controlling the non-contact guide apparatus according to the first embodiment of the invention.

FIG. 4 is a block diagram showing the structure of a control device for controlling non-contact guiding.

A control device 21 includes a sensor unit 22, an arithmetic unit 23 and a power amplifier 24. The control device 21 controls the attraction force of the magnet unit 6 which is disposed at each of the four corners of the car 4. Actually, the arithmetic unit 23 and power amplifier 24 are provided on a control board of the elevator, which is not shown.

The sensor unit 22 detects a physical amount in a magnetic circuit which is formed of the magnet unit 6 and guide rail 2*a*, 2*b*. The arithmetic unit 23 calculates a voltage which is to be applied to each coil 11, on the basis of a signal which is output from the sensor unit 22, so as to non-contactly guide the car 4. The power amplifier 24 supplies power to each coil 11 on the basis of the output from the arithmetic unit 23.

The sensor unit 22 is composed of a gap sensor 7 which detects the size of the gap between the magnet unit 6 and the guide rail 2*a*, 2*b*, and a current detector 25 which detects the value of an electric current which flows in each coil 11. The arithmetic unit 23 performs an arithmetic process relating to the five movement axes of x, y, θ, ξ and ϕ, which are shown in FIG. 1.

Figure 5:
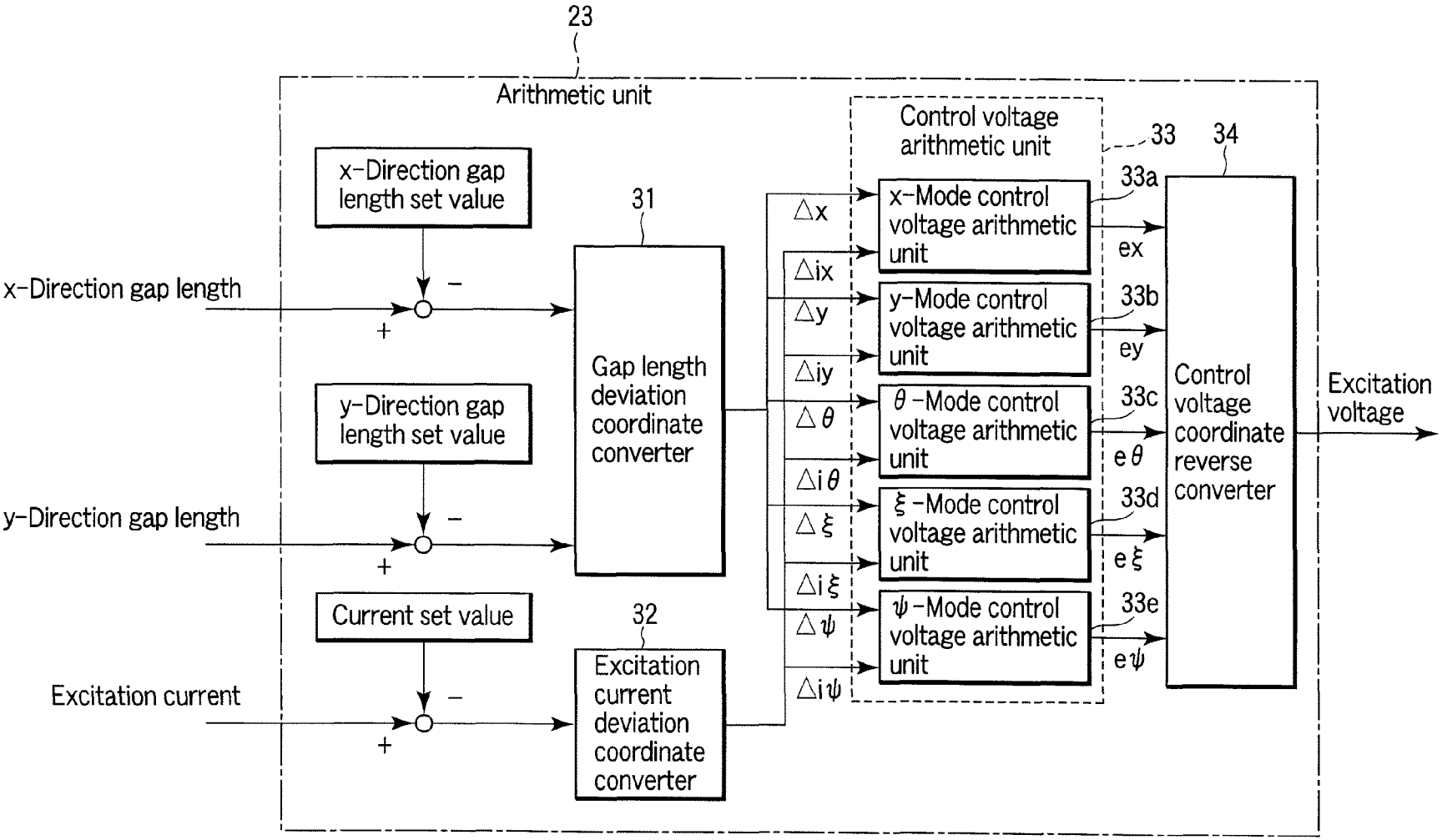
FIG. 5 is a block diagram showing the structure of an arithmetic unit which is provided in the control device in the first embodiment of the invention.

As shown in FIG. 5, the arithmetic unit 23 includes a gap length deviation coordinate converter 31, an excitation current deviation coordinate converter 32, a control voltage arithmetic unit 33 and a control voltage coordinate reverse converter 34.

The gap length deviation coordinate converter 31 performs arithmetic operations of the following parameters on the basis of a gap length which is obtained from each gap sensor 7 and a gap length deviation signal which indicates a difference between the gap length and a set value:

- a movement amount Δx in the x direction of the car 4,
- a movement amount Δy in the y direction of the car 4,
- a rotational angle Δθ in the θ direction (roll direction) of the car 4,
- a rotational angle Δξ in the ξ direction (pitch direction) of the car 4, and
- a rotational angle Δϕ in the ϕ direction (yaw direction) of the car 4.

The excitation current deviation coordinate converter 32 performs arithmetic operations of the following parameters on the basis of a current value which is obtained from the current detector 25 of each coil 11, and a current deviation signal which indicates a difference between the current value and a set value:

- a current deviation Δix relating to the movement in the x direction of the car 4,
- a current deviation Δiy relating to the movement in the y direction of the car 4,
- a current deviation Δiθ relating to the movement in the θ direction of the car 4,
- a current deviation Δiξ relating to the movement in the ξ direction of the car 4, and
- a current deviation Δiϕ relating to the movement in the ϕ direction of the car 4.

The control voltage arithmetic unit 33 performs arithmetic operations of electromagnet control voltages ex, ey, eθ, eξ and eϕ in five modes of x, y, θ, ξ and ϕ for stably non-contactly guiding the car 4, on the basis of the outputs Δx, Δy, Δθ, Δξ and Δϕ of the gap length deviation coordinate converter 31 and the outputs Δix, Δiy, Δiθ, Δiξ and Δiϕ of the excitation current deviation coordinate converter 32.

On the basis of the outputs ex, ey, eθ, eξ and eϕ of the control voltage arithmetic unit 33, the control voltage coordinate reverse converter 34 performs arithmetic operations of coil excitation voltages of the respective magnet units 6 and drives the power amplifier 24 on the basis of the result of the arithmetic operations.

To be more specific, the control voltage arithmetic unit 33 comprises an x-mode control voltage arithmetic unit 33*a*, a y-mode control voltage arithmetic unit 33*b*, a θ-mode control voltage arithmetic unit 33*c*, a ξ-mode control voltage arithmetic unit 33*d* and a ϕ-mode control voltage arithmetic unit 33*e*.

Figure 6:
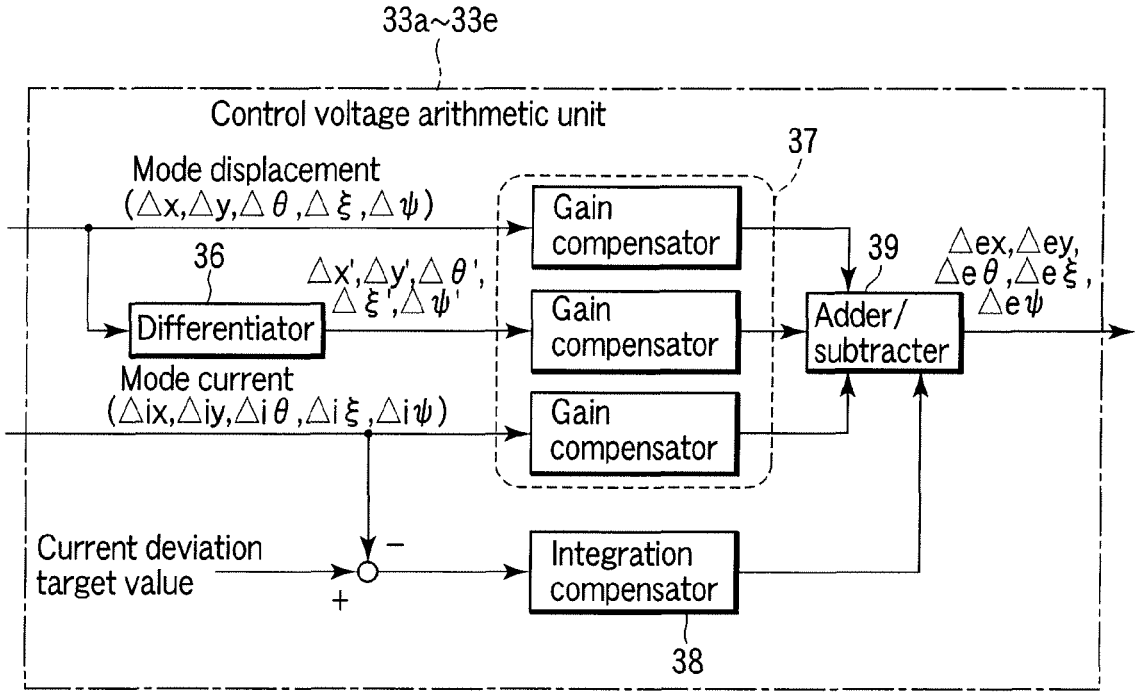
FIG. 6 is a block diagram showing the internal structure of the arithmetic unit which is provided in the control device in the first embodiment of the invention, and specifically showing the structure of a control voltage arithmetic unit in each mode.

FIG. 6 shows the internal structure of each of the control voltage arithmetic units 33*a* to 33*e*. Specifically, each of the control voltage arithmetic units 33*a* to 33*e* comprises a differentiator 36, a gain compensator 37, an integration compensator 38 and an adder/subtracter 39.

The differentiator 36 calculates time variation ratios Δx', Δy', Δθ', Δξ' and Δϕ' on the basis of the mode displacements Δx, Δy, Δθ, Δξ and Δϕ.

The gain compensator 37 multiplies by proper control gains the mode displacements Δx, . . . , the time variation ratios Δx', . . . , of the mode displacements, and the mode currents Δix, . . . .

The integration compensator 38 integrates the difference between a current deviation target value and the mode current Δix, . . . , and multiplies the difference by a proper control gain.

The adder/subtracter 39 adds/subtracts the output values of all the gain compensators 37 and integration compensator 38, thereby calculating excitation voltages (ex, ey, eθ, eξ and eϕ) of the respective modes (x, y, θ, ξ and ϕ.

By executing feedback control by the arithmetic unit 23 having the above-described structure, the current for exciting each coil 11 is controlled so as to maintain a predetermined gap length between the magnet unit 6 and the guide rail 2*a*, 2*b*. Thereby, in a steady state, the gap length in each magnet unit 6 is set at such a value that the magnetic attraction force of each magnet unit by the magnetomotive force of the permanent magnet 9 is well balanced with the x-direction force, y-direction force, θ-direction torque, ξ-direction torque and ϕ-direction force, which act on the car 4.

As described above, in the steady state, the excitation current of the coil 11 is reduced to zero. Thereby, the car 4 can stably be supported by the attraction force of the permanent magnets 9, regardless of the weight of the car 4 and the magnitude of unbalanced force. This control is called "zero-power control".

By this zero-power control, the car 4 can stably be supported in the state in which the car 4 is not in contact with the guide rails 2*a*, 2*b*. In addition, in the steady state, the current flowing in each coil 11 gradually decreases to zero, and the force that is needed for stable support becomes only the magnetic force of the permanent magnets 9.

This also applies to the case in which the weight or balance of the car 4 varies. Specifically, in a case where some external force acts on the car 4, an electric current is caused to transitionally flow in the coils 11, thereby to adjust the gap between the guide apparatus, 5*a*, 5*b*, 5*c*, 5*d* and the guide rail 2*a*, 2*b* at a suitable size. However, when transition to the stable state has occurred once again, the current flowing in the coil 11 gradually decreases to zero by the above-described control method. It is thus possible to form a gap which has such a size that the load acting on the car 4 and the attraction force produced by the magnetic force of the permanent magnet 9 are balanced.

The structure of the magnet unit and the zero-power control in the levitation guiding are described in detail in Jpn. Pat. Appln. KOKAI Publication No. 2001-19286, and a detailed description thereof is omitted here.

(Operation)

Next, a description is given of the operation of the car 4 at a time when the car 4 levitates from the state of contact with the guide rail 2*a*, 2*b*, and transitions to the non-contact guide state (the state in which non-contact guiding/running is possible).

Figure 7:
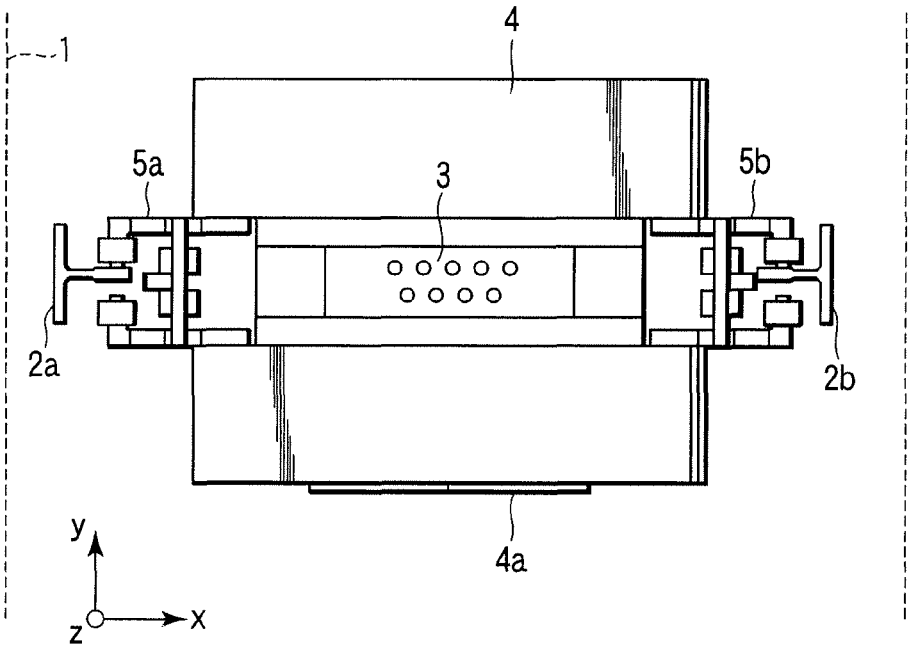
FIG. 7 is a plan view in a case where the contact state of the car of the elevator according to the first embodiment of the invention is viewed from above.

FIG. 7 is a plan view in a case where the car 4 of the elevator is viewed from above when non-contact guide control is not executed. The guide apparatuses 5*a*, 5*b*, 5*c* and 5*d* have their portions put in contact with the guide rails 2*a* and 2*b*. FIG. 7 shows only the guide apparatuses 5*a* and 5*b* which are mounted on the upper part of the car 4. The horizontal direction on the sheet surface of FIG. 7 is x, and the vertical direction on the sheet surface of FIG. 7 is y.

Figure 8:
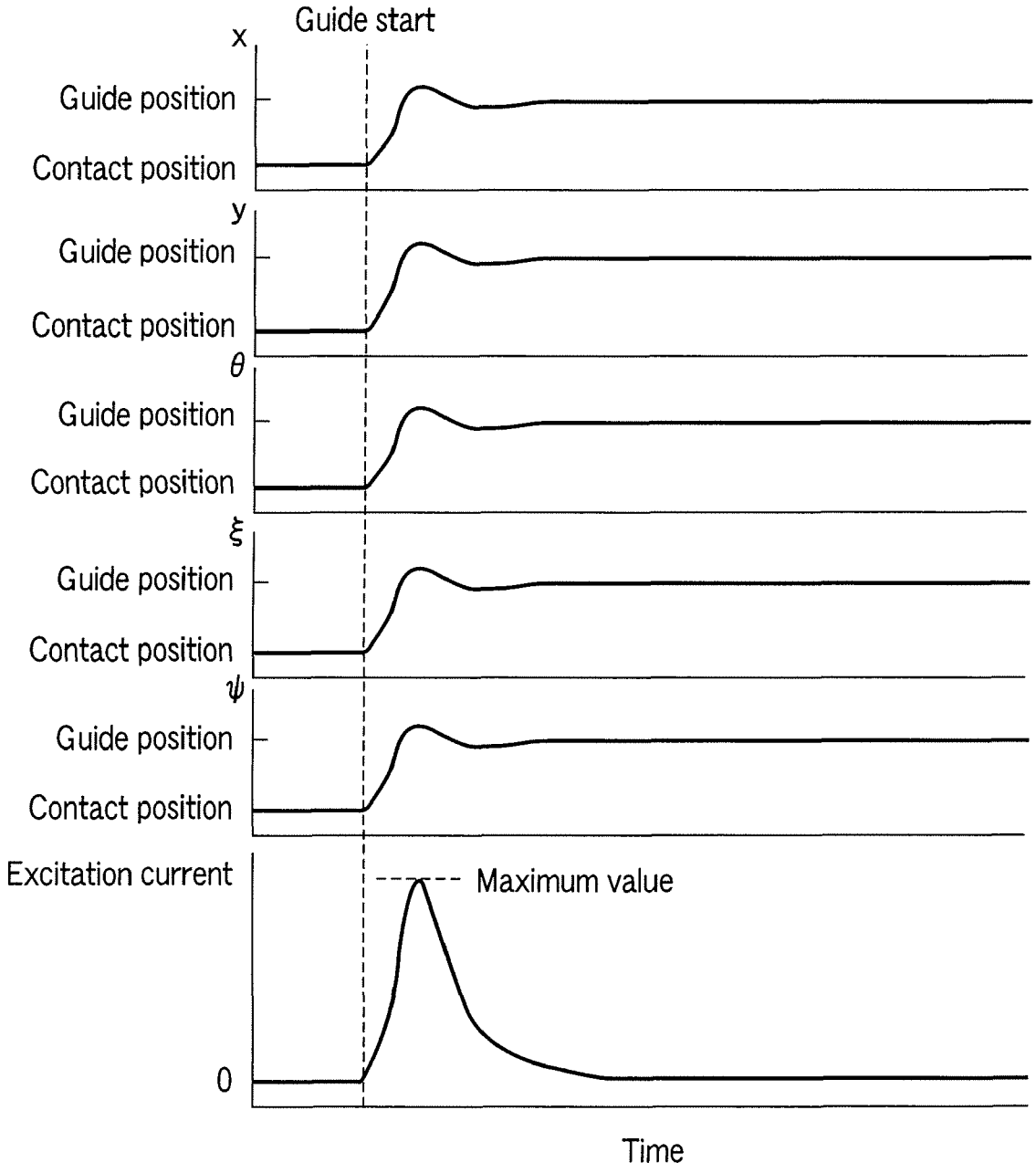
FIG. 8 is a graph for explaining the relationship between the operation and electric current in respective movement axes in a conventional system.

Normally, when the non-contact guide control is started from this state, all control systems, which are designed for the five movement axes x, y, θ, ξ and ϕ, except the up-and-down direction (z direction) of the car 4, are operated, and excitation currents are supplied to the coils 11 of the guide apparatus 5*a*, 5*b*, 5*c* and 5*d* so as to effect levitation in all movement axes at the same time. Thus, as shown in FIG. 8, electric currents that are necessary for levitation in all movement axes instantaneously flow in the respective coils 11, and a very high excitation current is produced. Hence, as described in the section of the description of the prior art, the power supply capacity of the guide apparatus needs to have a sufficient allowance.

In the present embodiment, when the non-contact guide control is started, control (control of excitation current) is executed with respect to only some of the five movement axes x, y, θ, ξ and ϕ. Subsequently, after a predetermined time has passed and stabilization is effected, control for the other movement axes is executed. Thereby, the instantaneous flow of a large current is prevented, and the total power consumption is reduced.

Figure 9:
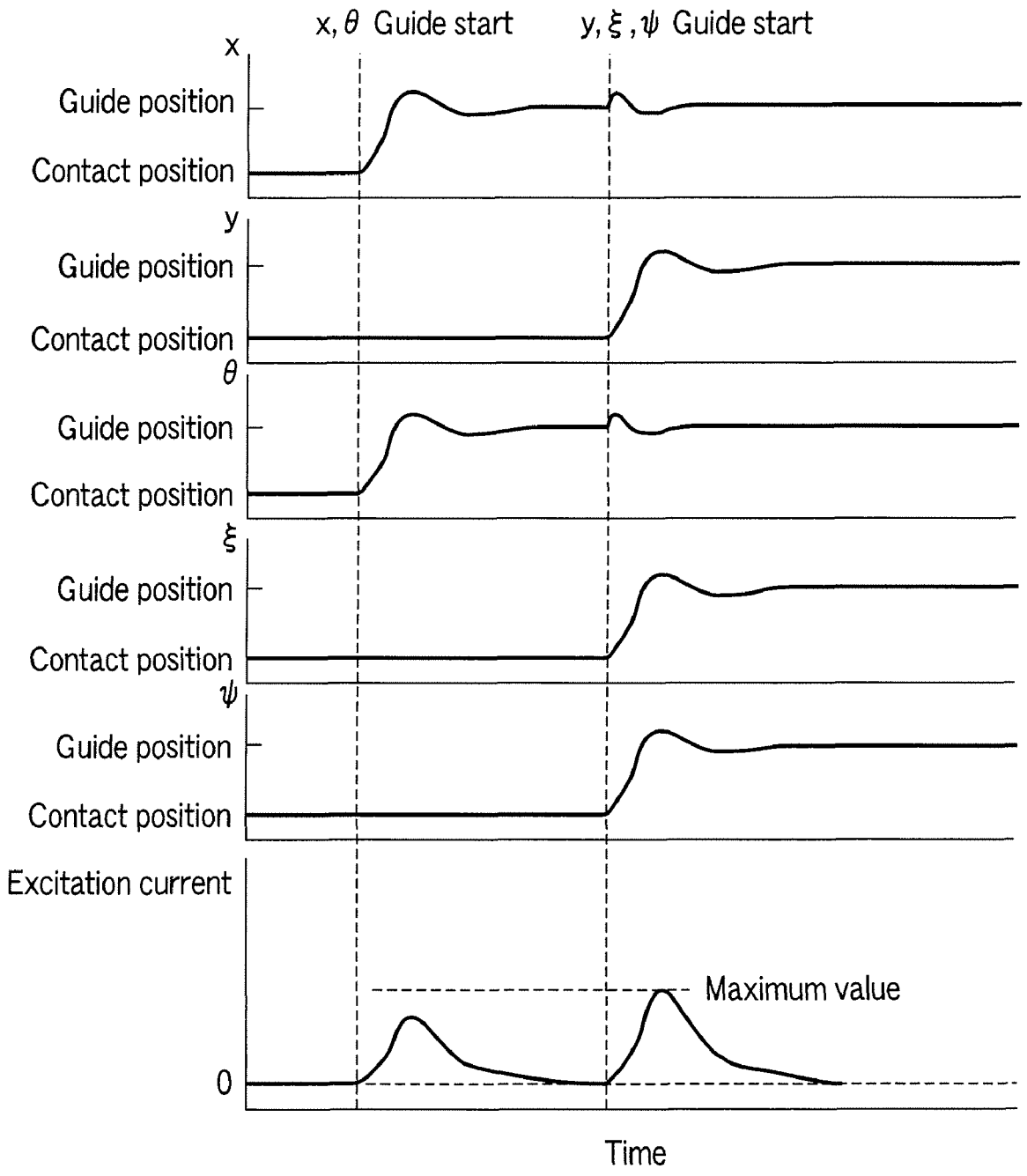
FIG. 9 is a graph for explaining the relationship between the operation and electric current in respective movement axes in the first embodiment of the invention.

In the description below, it is assumed that control for the two movement axes in the x direction and θ direction is first executed. FIG. 9 shows the relationship between the variations in the respective movement axes and the sum of absolute values of electric currents that excite all the coils.

In this case, as shown in FIG. 9, the car 4 first levitates only in the directions of the x axis and θ axis, thus transitioning to the non-contact guide state. At this time, the electric current that is needed is only the current that is used for current control for the two axes.

Then, when a predetermined time has passed and the guide control in the x direction and θ direction is stabilized, the control for the other movement axes y, ξ and ϕ is executed while maintaining the stable non-contact guide state. The current that is necessary at this time is the current that is used for activation in the three axes and the current that is needed to maintain the attitude in the two axes, which is already in the non-contact guide state.

Figure 10:
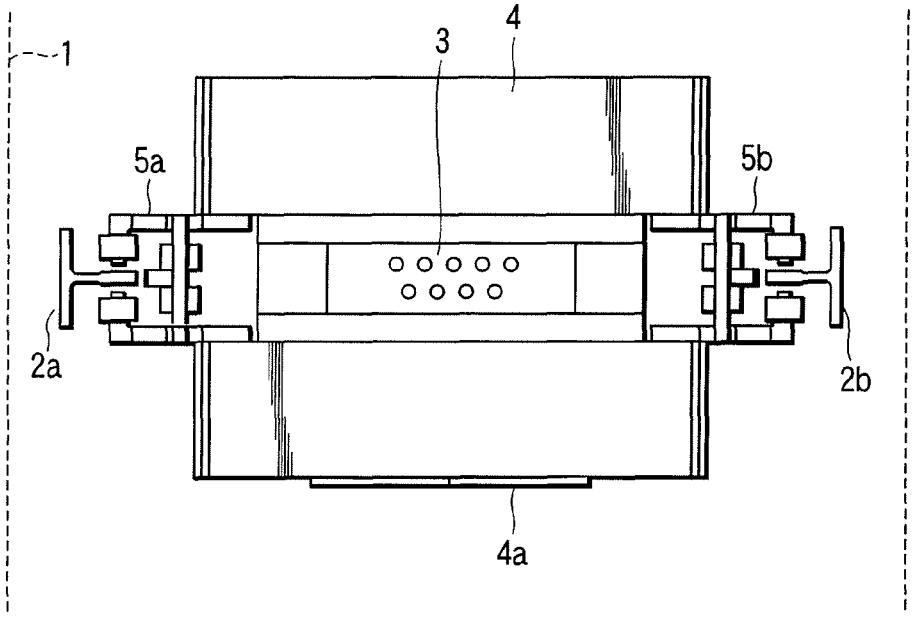
FIG. 10 is a plan view in a case where the non-contact guide state of the car of the elevator according to the first embodiment of the invention is viewed from above.

By starting the guiding by the above-described process, the car 4 is finally stably levitated in all the movement axes x, y, θ, ξ and ϕ. Thus, as shown in FIG. 10, the car 4 is run and guided without contact with the guide rail 2*a*, 2*b*.

At this time, since the timings of the start of control for the respective movement axes are displaced, the car 4 can non-contactly be guided with a current value which is lower than the current value that is necessary for simultaneously effecting levitation in all axes at the time of the start of guiding.

In the present embodiment, since zero-power control is executed in each movement axis, the control current for controlling the respective movement axes decreases to zero in the state in which stable levitation is effected in the respective movement axes. Accordingly, after the stabilization in the movement axes for which the control is first executed, the levitation state can be maintained with a very small current. Thus, even if the current that is needed for levitation in the movement axes, for which control is subsequently started, is added, the total current value is relatively small.

As described above, by displacing the timings of the start of control for the respective movement axes, the maximum value of the current that is necessary for non-contact guide control can be decreased, and the power supply capacity of the guide apparatus can be made less than that in the prior art.

In this example, the control for the x and θ axes is first executed, and then the control for the y, ξ and ϕ axes is executed. However, the combination for the start of control is not limited, and arbitrary combinations may be possible.

In addition, in this example, the timing of the start of control is divided into two timings. However, the timing may be divided into a greater number. In such a case, the maximum current can further be reduced.

Second Embodiment

Next, a second embodiment of the present invention is described.

Figure 11:
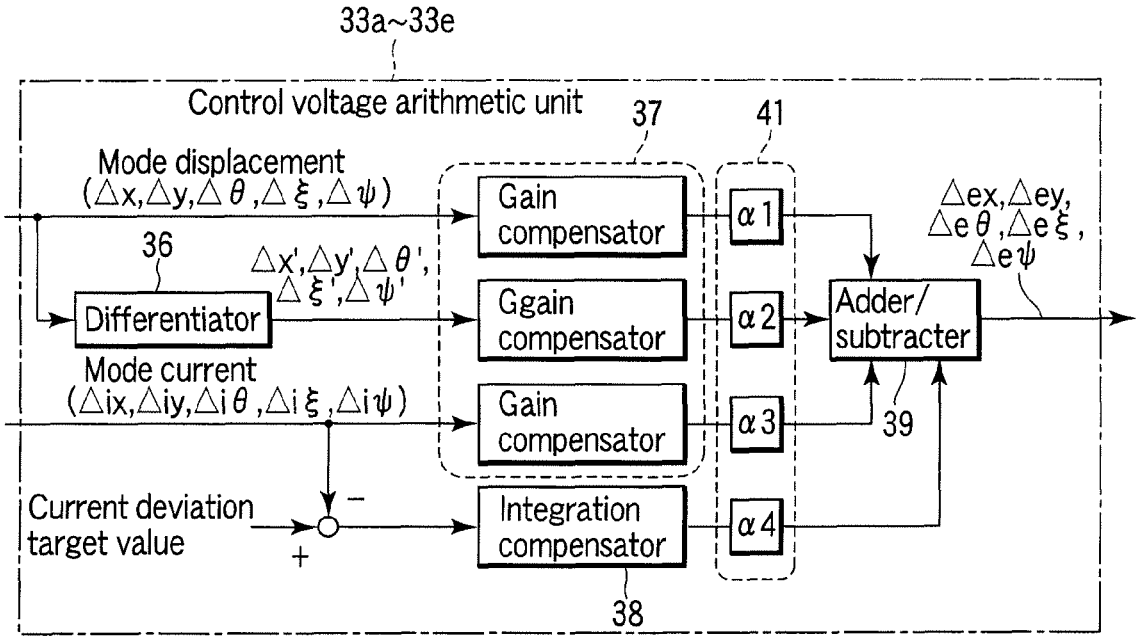
FIG. 11 is a block diagram showing the structure of a control voltage arithmetic unit in each mode in a second embodiment of the present invention.

FIG. 11 is a block diagram showing the structure of a control voltage arithmetic unit, 33*a* to 33*e*, according to the second embodiment of the invention. The difference from FIG. 6 is the addition of a gain coefficient multiplier 41.

Specifically, in the second embodiment, like the first embodiment, the car 4 of the elevator is levitated and guided by magnetic force. At this time, the gain coefficient multiplier 41 is configured to multiply the control gains of the gain compensator 37 for each movement axis and the integration compensator 38 by predetermined gain coefficients (α1, α2, α3, α4).

In this structure, the value of the gain coefficient is normally set at "1", and the magnet unit 6 is controlled with a preset control gain (i.e. the control gain ×1).

Figure 12:
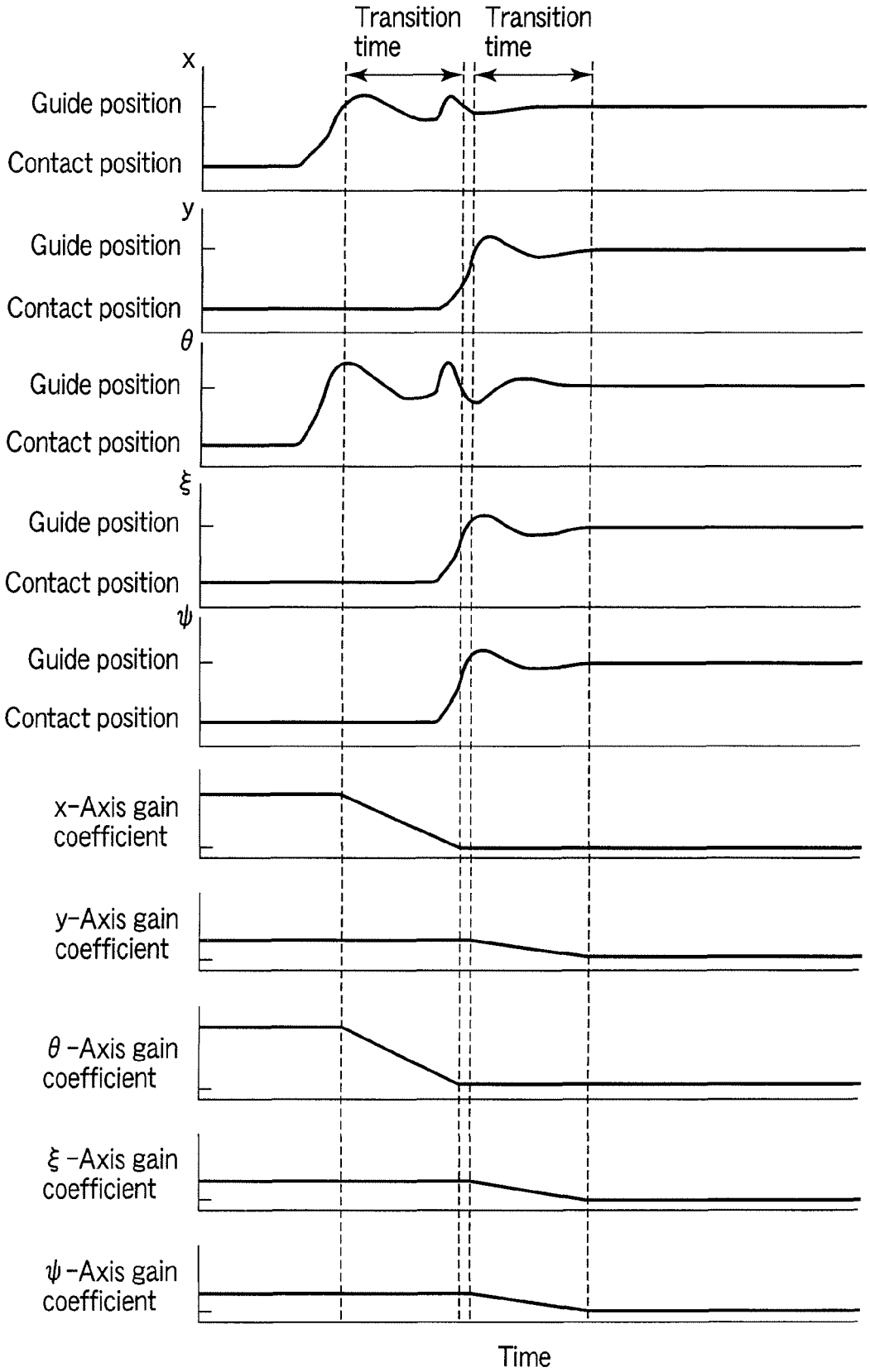
FIG. 12 is a graph for explaining the relationship between the operation and electric current in respective movement axes in the second embodiment.

For example, as shown in FIG. 12, when the non-contact guide control is executed, the gain coefficients relating to the x axis and θ axis are set to be greater than "1". A value, up to which the gain coefficient is to be increased, is determined on the basis of, e.g. the levitation performance of the guide apparatus.

If the gain coefficients relating to the x axis and θ axis are increased, the control gains, which are finally obtained, become relatively greater than those relating to the other axes. Accordingly, the force relating to the x axis and θ axis mainly acts on the car 4, and the car 4 is set in the non-contact guide state with respect to the x axis and θ axis. At this time, since excitation currents, which are sufficient for non-contact guiding, are not supplied with respect to the other axes, i.e. the axes y, ξ and ϕ, for which the control gain is relatively low, it is possible that levitation in these axes is not effected.

Thus, the gain coefficients relating to the x axis and θ axis are gradually made closer to "1". Then, while the non-contact guide is kept with respect to the x axis and θ axis, the control gains relating to the other axes relatively increase. If sufficient excitation currents are generated with respect to the y, ξ and ϕ axes, the non-contact guide state is also effected with respect to these axial directions.

Thereafter, when stabilization is also effected with respect to the y, ξ and ϕ axes, the gain coefficients relating to these axes are restored to the normal value "1", and thereby the guide control by the preset control gains is executed. At this time, if the magnitudes of the gain coefficients are made to differ between the movement axes or if the gain coefficients of some of the movement axes are kept at the normal value "1", it becomes possible to determine the order in which transition to the non-contact guide state occurs with respect to the respective movement axes.

In addition, as shown in FIG. 12, if a predetermined transition time period is provided and the gain coefficient is linearly varied in this period, no sharp variation occurs in the control state and the control gain can smoothly and stably be varied. Thereby, the car 4 can stably be guided without causing great shock to the car 4.

Figure 13:
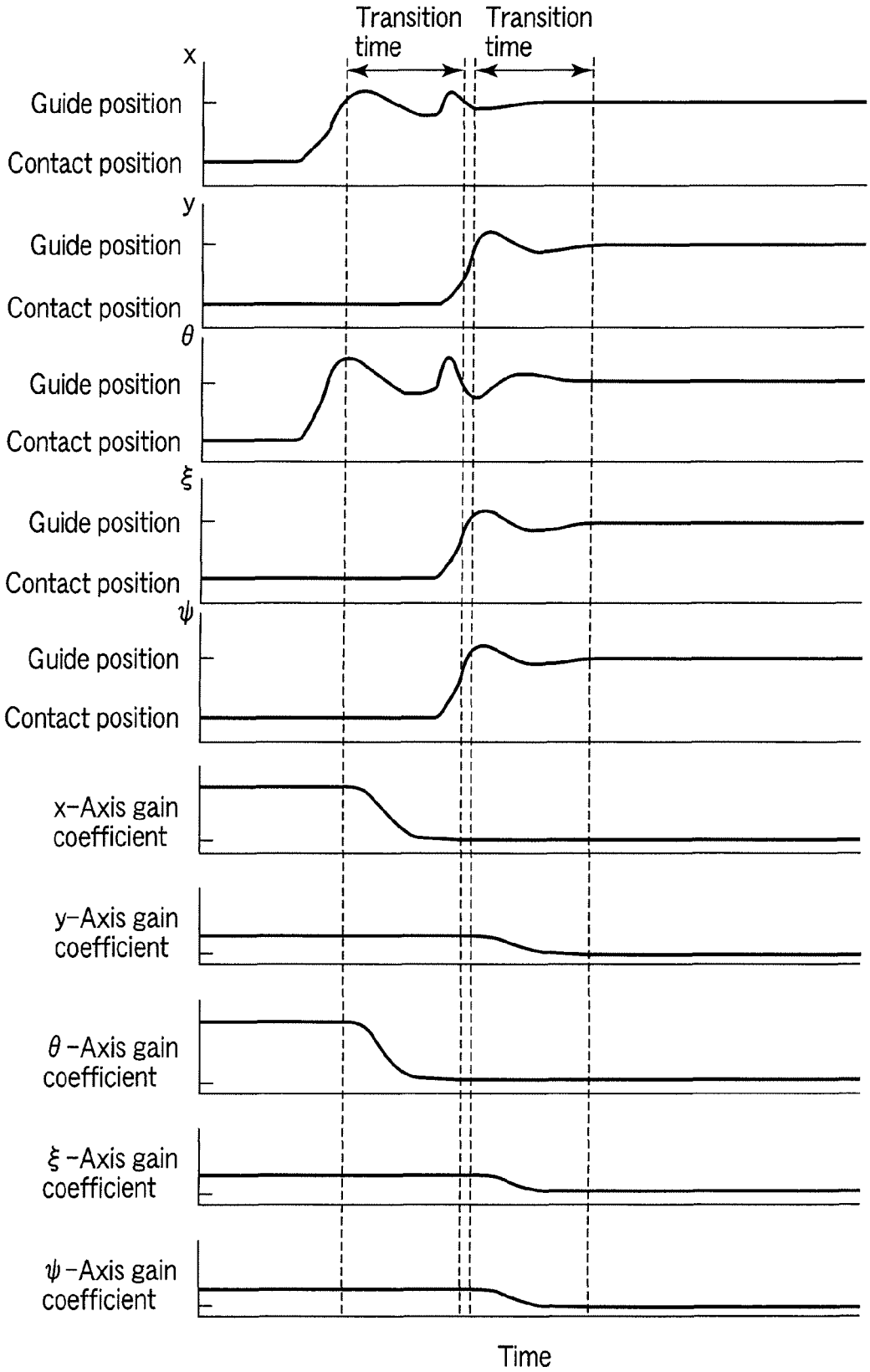
FIG. 13 is a graph for explaining the relationship between the operation and electric current in respective movement axes in a case where a low-pass filter is used in the second embodiment of the invention.

Besides, instead of the linear variation, the gain coefficient may be varied via a predetermined low-pass filter. Also by varying the gain coefficient via the low-pass filter in this manner, the value of the control gain can smoothly be varied, as shown in FIG. 13.

As has been described above, also by varying the gain coefficients relating to the respective movement axes with the passing of time, the maximum value of the electric current that is needed for the non-contact guide control can be reduced, like the first embodiment, and the power supply capacity of the guide apparatus can be made less than in the prior art.

Third Embodiment

Next, a third embodiment of the present invention is described.

Since the basic circuit structure is the same as that of the second embodiment shown in FIG. 11, a description is given below of how to apply gain coefficients.

Specifically, in the third embodiment, like the second embodiment, the car 4 is guided by the magnetic force, and the gain coefficient multiplier 41 is configured to multiply the control gains for the respective movement axes by predetermined gain coefficients ($\alpha 1$, $\alpha 2$, $\alpha 3$, $\alpha 4$).

In this structure, the value of the gain coefficient is normally set at "1", and each magnet unit 6 is controlled with a preset control gain. The guide control is executed by varying the gain coefficients in accordance with the guide state of the car 4.

At the time of non-contact guide, if the guide position in each movement axis for each magnet unit 6 is within a predetermined guide range (levitation range), the gain coefficient is controlled and set at "1" for the normal time. On the other hand, if the guide position is out of the predetermined guide range, the gain coefficient is set at a value greater than "1" for the normal time. The guide position that is out of the predetermined guide range refers to a contact state or a state in which the guide position is greatly apart from the stable position.

Figure 14:
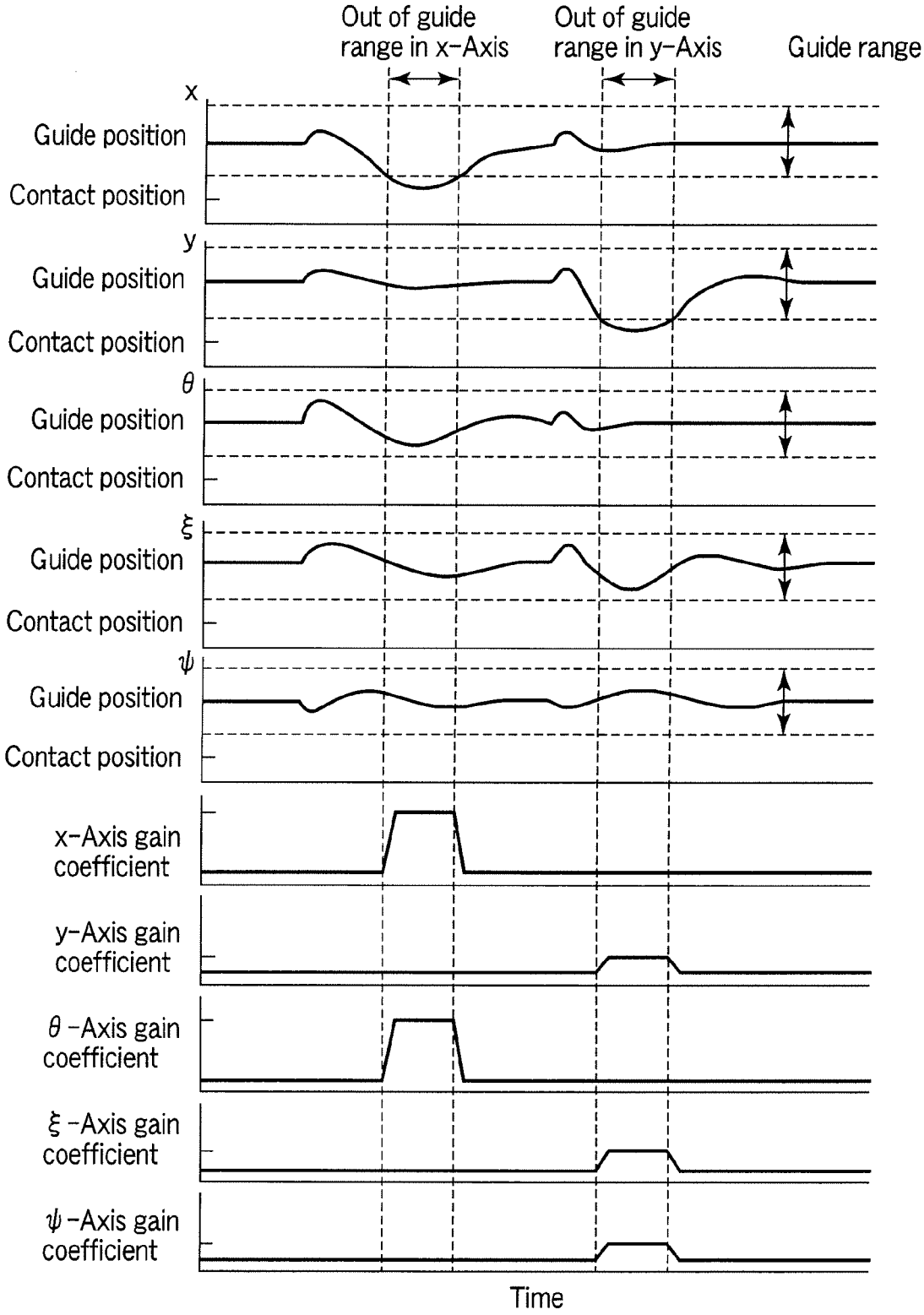
FIG. 14 is a graph for explaining the relationship between the operation and electric current in respective movement axes in a third embodiment of the invention.

For example, as shown in FIG. 14, if the positional displacements relating to the x axis and $\theta$ axis are out of the predetermined guide range, the gain coefficients relating to the control gains for the movement axes of the x axis and $\theta$ axis are set at values which are greater than "1" for the normal time. A value, up to which the gain coefficient is to be increased, is determined on the basis of, e.g. the levitation performance of the guide apparatus.

Thereby, a greater feedback than a normal feedback is executed with respect to the movement axis which is out of the predetermined guide range. Accordingly, a greater force for correction to the stable position acts with respect to this movement axis, and as a result the non-contact guide state of the car 4 can be maintained.

The same applies to the case in which the positional displacements relating to the y, $\xi$ and $\phi$ exceed the predetermined guide range. Specifically, the gain coefficients relating to the control gains for these movement axes are increased and a greater feedback is executed.

Figure 15:
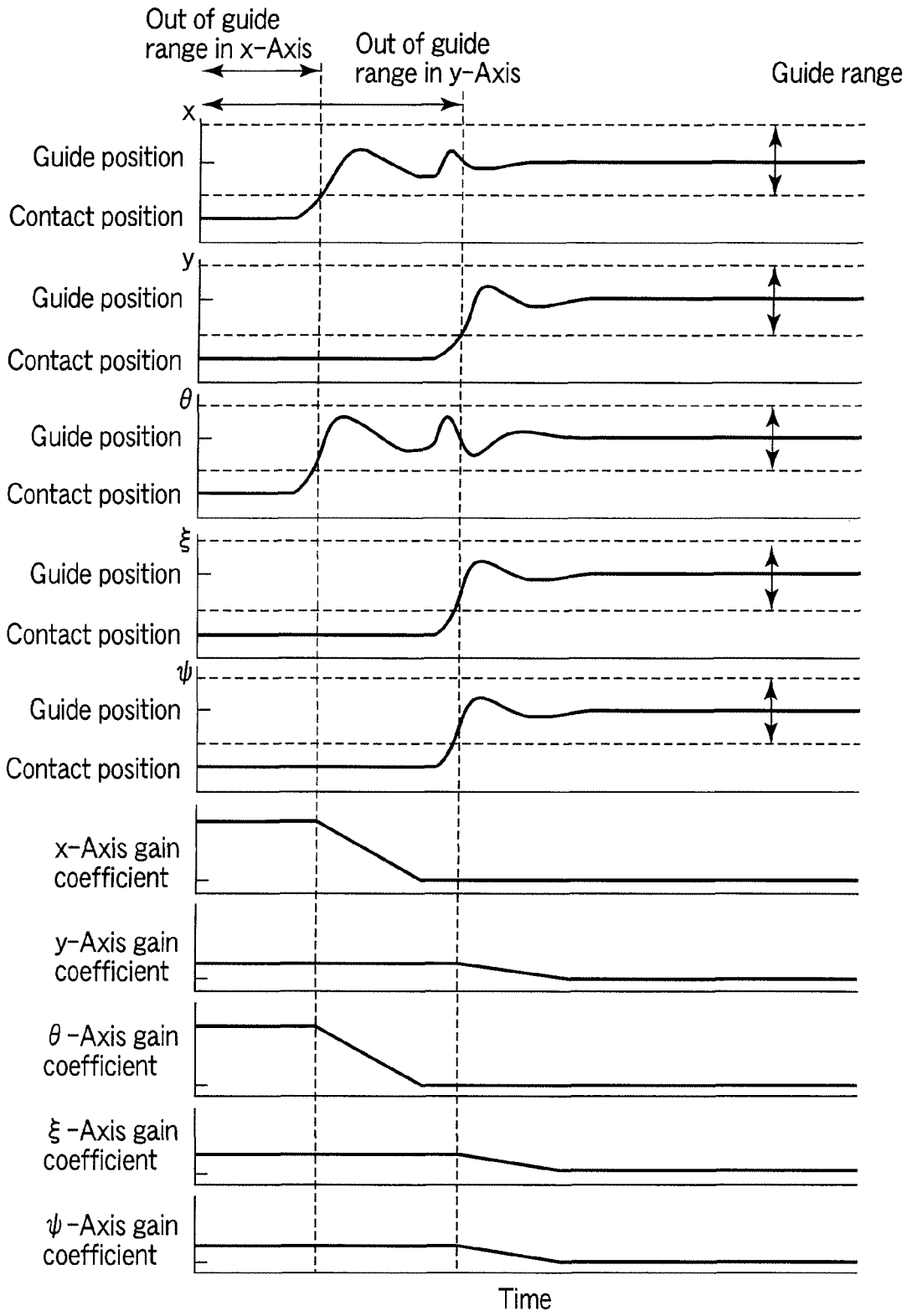
FIG. 15 is a graph for explaining the relationship between the operation and electric current in respective movement axes in the third embodiment of the invention.

Further, as regards the values of the gain coefficients for the respective axes, a difference is provided between the magnitudes of the gain coefficients relating to specified axes (e.g. the x axis and $\theta$ axis) and the magnitudes of the gain coefficients relating to the other axes (e.g. the y, $\xi$ and $\phi$ axes). In the case where no guide control is executed, as shown in FIG. 15, the car 4 and guide apparatuses 5*a*, 5*b*, 5*c* and 5*d* are in contact with the guide rails 2*a* and 2*b*. At this time, the respective movement axes, or the guide positions of the magnet units 6, are out of the predetermined range. Thus, greater gain coefficients than usual are applied to the control gains.

In this case, by providing a difference between the gain coefficients for the respective movement axes, a difference occurs between the control gains relating to the respective axial directions when the car 4 is in contact with the guide rails 2*a* and 2*b*.

For example, the gain coefficients relating to the x axis and $\theta$ axis are set to be greater than the gain coefficients relating to the y, $\xi$ and $\phi$ axes. Thereby, when the levitation control is started, a high feedback is executed with respect to the x axis and $\theta$ axis, and transition occurs to the non-contact guide state with respect to the x axis and $\theta$ axis. Thereafter, when the guide positions relating to the x axis and $\theta$ axis have fallen within the predetermined range, the values of the gain coefficients relating to the x axis and $\theta$ axis are varied to the normal values.

Then, the control gains relating to the y, $\xi$ and $\phi$ axes become relatively great, since no transition to the non-contact guide state has occurred for these axes and the gain coefficients relating to the y, $\xi$ and $\phi$ axes, with respect to which the guide positions are out of the predetermined range, are set at large values. Accordingly, such a force as to effect transition to the non-contact guide state acts with respect to these movement axes. If the transition to the non-contact guide state is effected at last with respect to all axial directions and the guide positions fall within the predetermined range, the gain coefficients relating to all axes are set at the normal value "1", and the stable guide control by the preset control gains can be executed.

Like the second embodiment, it is possible to linearly vary the gain coefficient during a predetermined transition time period, or to smoothly vary the gain coefficient via a low-pass filter, instead of causing a sharp variation of the gain coefficient. Thereby, the guide state of the car 4 can stably be transitioned.

When the guide position is out of the predetermined range, the control gain is varied. Thereby, at the normal guide time, even if the car 4 is likely to come in contact with the guide rail 2*a*, 2*b* due to some external disturbance, the control gain can quickly be increased, and the contact with the guide rail 2*a*, 2*b* can be avoided.

As has been described above, also by varying the gain coefficients relating to the respective movement axes in accordance with the positional displacements for the individual movement axes, the maximum value of the electric current that is needed for the non-contact guide control can be reduced, like the first embodiment, and the power supply capacity of the guide apparatus can be made less than in the prior art.

In the meantime, in the second and third embodiments, the gain coefficients are provided with respect to all control gains for the respective control axes. However, there is no need to provide gain coefficients with respect to all control gains. Gain coefficients may be provided with respect to only some of the control gains.

Fourth Embodiment

Next, a fourth embodiment of the present invention is described.

Figure 16:
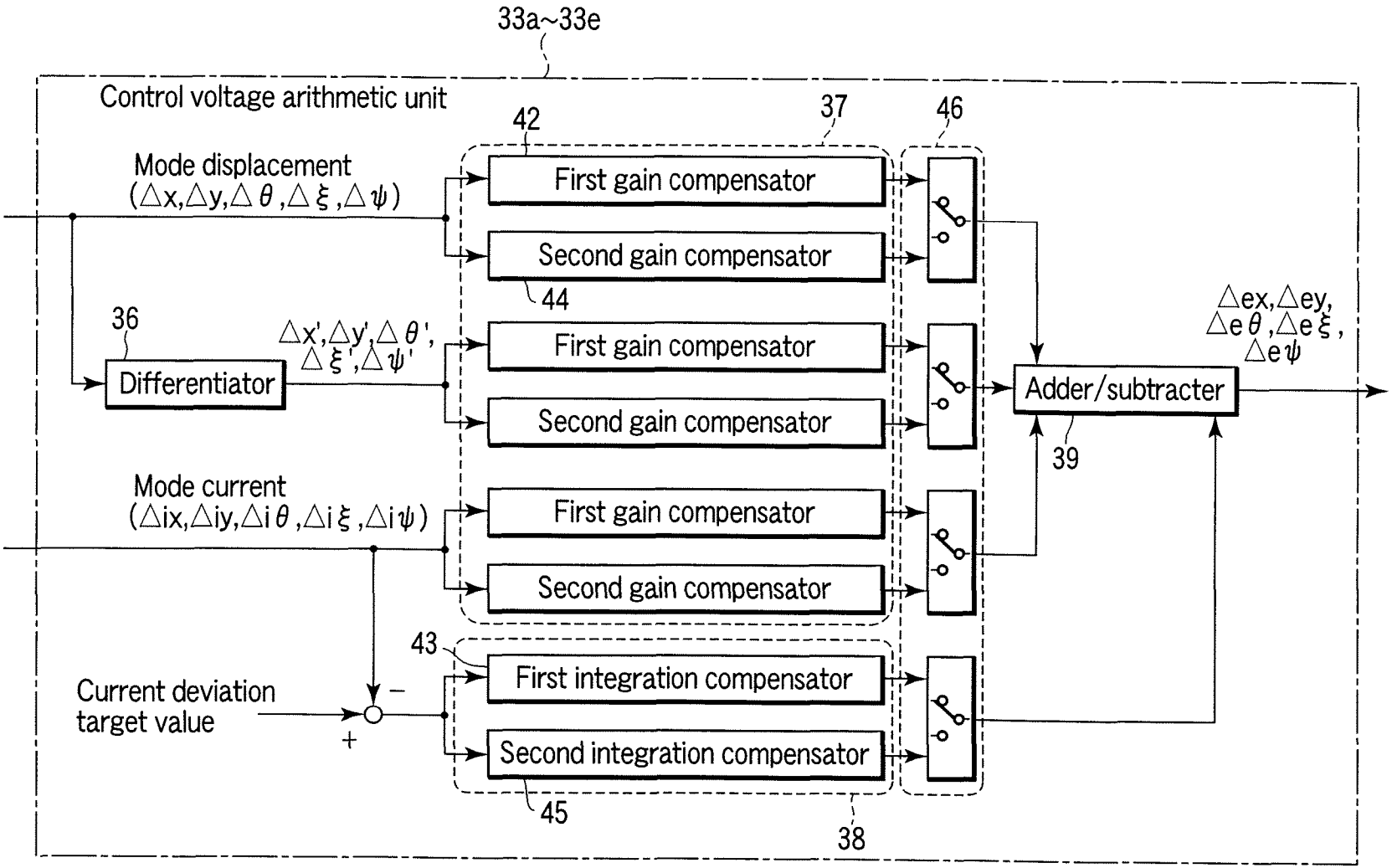
FIG. 16 is a block diagram showing the structure of a control voltage arithmetic unit in each mode in a fourth embodiment of the present invention.

FIG. 16 is a block diagram showing the structure of a control voltage arithmetic unit, 33*a* to 33*e*, according to a fourth embodiment of the invention, and FIG. 16 corresponds to FIG. 6. The difference from FIG. 6 is that the gain compensator 37 comprises first gain compensators 42 and second gain compensators 44. In addition, the integration compensator 38 comprises a first integration compensator 43 and a second integration compensator 45.

Specifically, in the fourth embodiment, like the first embodiment, the car 4 is guided by magnetic force. At this time, as shown in FIG. 16, at least two kinds of control gains are set for each movement axis.

In the example shown in FIG. 16, control gains for use in the first gain integrators 42 and first integration compensator 43 are set as first control gains, and control gains for use in the second gain integrators 44 and second integration compensator 45 are set as second control gains.

As regards at least one movement axis, at least one of the second control gains is set at a value that is greater than the first control gain, so that a great control may be executed as a whole. Further, a switching unit 46 is provided for effecting switching between the first control gain and the second control gain.

Figure 17:
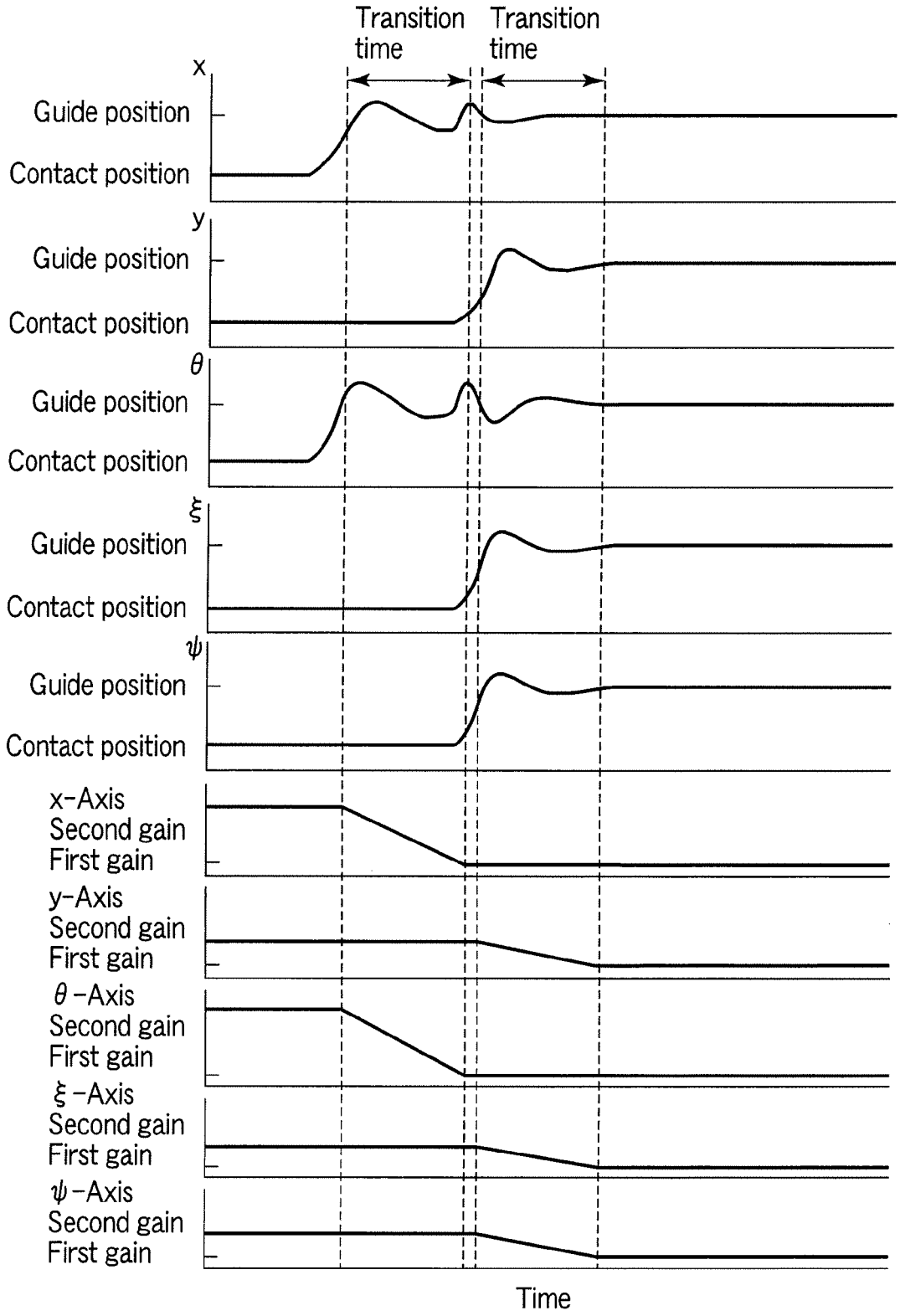
FIG. 17 is a graph for explaining the relationship between the operation and electric current in respective movement axes in the fourth embodiment of the invention.

Assume now that the second control gains relating to the two movement axes of the x direction and θ direction have relatively large values, and the second control gains relating to the y, ξ and ϕ have relatively small values. As shown in FIG. 17, in the case where the second control gain is used when the guide is started, the transition to the non-contact guide state first occurs with respect to the movement axes of the x axis and θ axis, for which control with a relatively great gain is executed.

At the time point when stabilization for the x axis and θ axis is effected and the non-contact guide state is created, the control gain relating to the x axis and θ axis is switched from the second control gain to the first control gain by the switching unit 46. Then, since the control gains relating to the y, ξ and ϕ axes increase, the transition to the non-contact guide state occurs with respect to these axial directions. At the time point when the transition to the non-contact guide state is effected with respect to all axial directions, these control gains are switched to the first control gains, thus setting the normal guide state.

When the first control gain and the second control gain are switched, the gain may be linearly varied during a predetermined transition time period that is needed, or the gain may be smoothly varied via a low-pass filter. Thereby, a person riding in the car 4 can be prevented from feeling a quick change of control.

In the above-described embodiment, a clear difference in magnitude is provided between the second control gains for the respective movement axes. However, there is no problem even if there is no clear difference between the second control gains. When the guide is started, there may be such a case that quicker stabilization to the steady state is needed than at the normal guide time. It is thus effective to use the second control gains at the time of start of guiding, which are different from the control gains at the time of the normal guide time.

In the structure of the above-described embodiment, the two kinds of control gains (first control gains and second control gains) are provided with respect to the individual movement axes. It is possible, however, to provide a greater number of control gains, and to switch them with the passing of time.

As has been described above, also by providing a plurality of different control gains with respect to the movement axes and switching them with the passing of time, the maximum value of the electric current that is needed for the non-contact guide control can be reduced, like the first embodiment, and the power supply capacity of the guide apparatus can be made less than in the prior art.

Fifth Embodiment

Next, a fifth embodiment of the present invention is described.

Since the basic circuit structure is the same as that of the fourth embodiment shown in FIG. 16, a description is given below of how to switch the control gains.

Specifically, in the fifth embodiment, like the fourth embodiment, at least two kinds of control gains are set for use in the gain compensators 37 and the integration compensator 38 relating to the respective movement axes.

Control gains at the normal guide time, which are used when the guide position is within the predetermined range, are used in the first gain compensator 42 and first integration compensator 43. Control gains, which are used when the guide position is out of the predetermined range, are used in the second gain compensator 44 and second integration compensator 45.

The control gains for use in the first gain integrators 42 and first integration compensator 43 are set as first control gains. The control gains for use in the second gain integrators 44 and second integration compensator 45 are set as second control gains.

Figure 18:
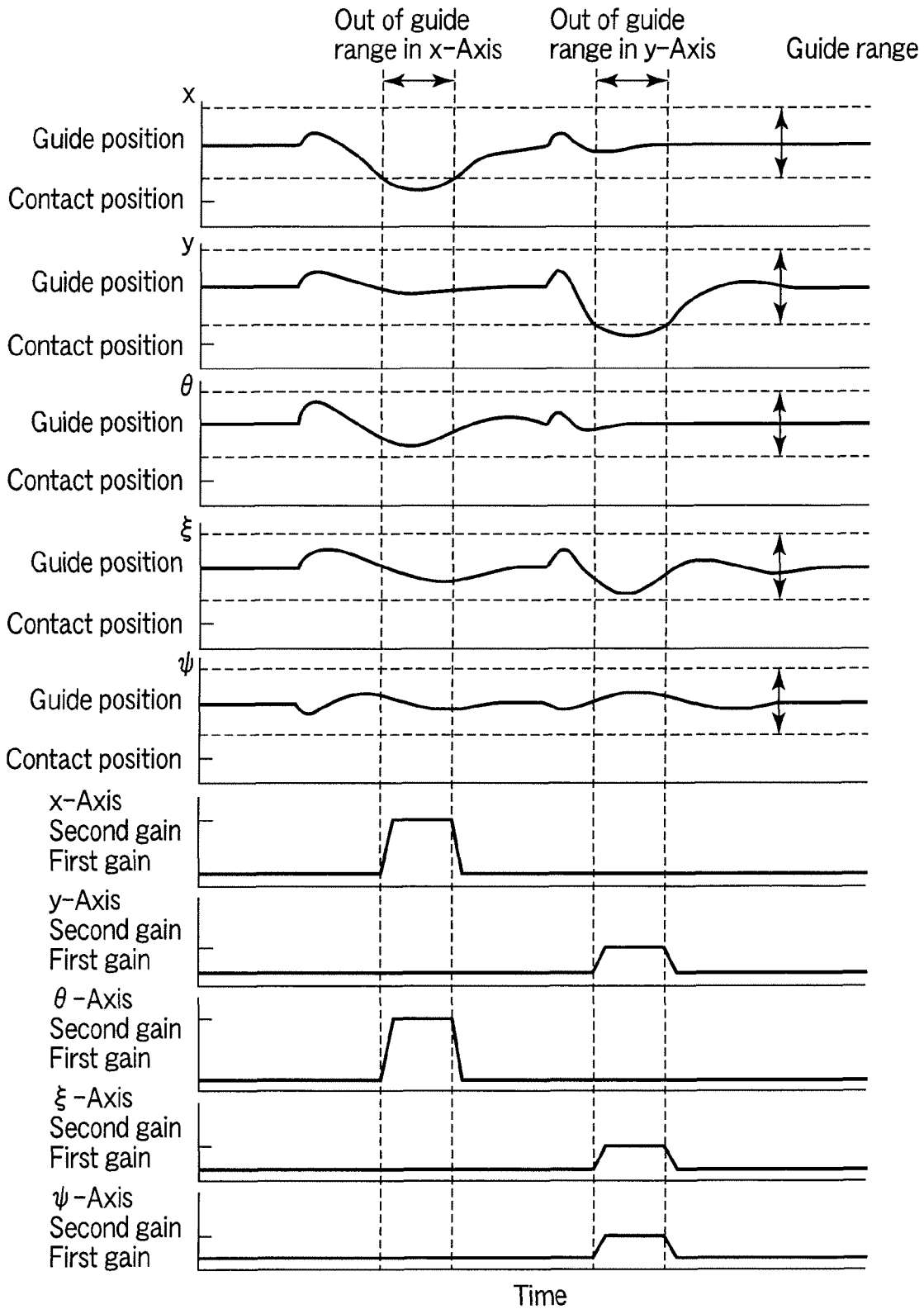
FIG. 18 is a graph for explaining the relationship between the operation and electric current in respective movement axes in a fifth embodiment of the invention.

As shown in FIG. 18, at the time of guide control, the first control gains are used for the control. If the guide position falls out of the predetermined range due to some external disturbance during the control, the first control gains are switched to the second control gains. At this time, the second control gains are set to be higher than the first control gains. Thereby, when the car 4 is likely to come in contact with the guide rail 2*a*, 2*b*, a relatively strong force acts to restore the car 4 to the stable state.

Figure 19:
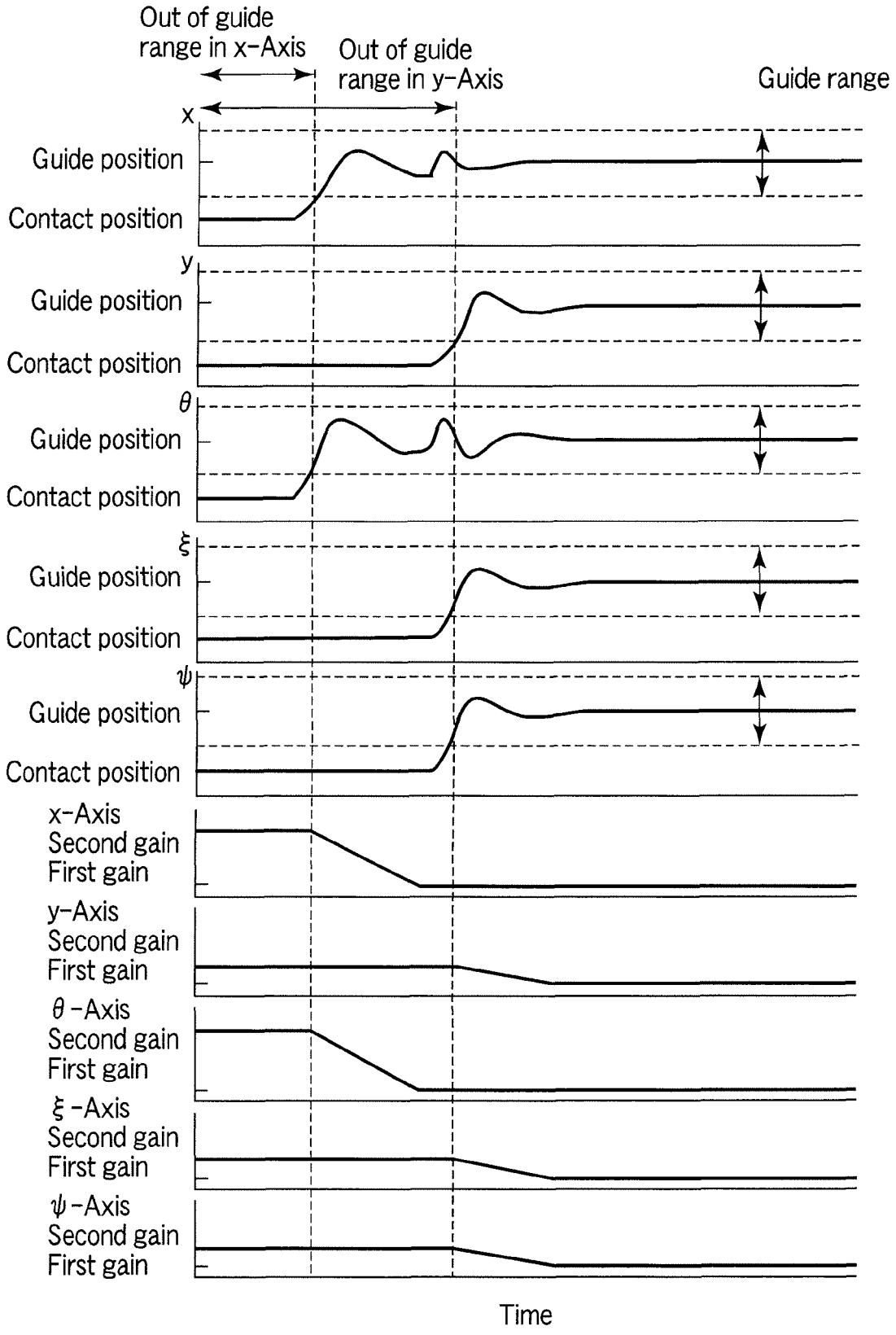
FIG. 19 is a graph for explaining the relationship between the operation and electric current in respective movement axes in the fifth embodiment of the invention.

In the case where the car 4 is in contact with the guide rails 2*a* and 2*b*, the second control gains are used. Thus, when the guide is started, the second control gains are necessarily used. At this time, a clear difference is provided in magnitude between the second control gains for the respective movement axes. Thereby, as shown in FIG. 19, the order of axes, in which transition occurs to the non-contact guide state when the guide is started, can arbitrarily be set. Therefore, the movement axes can successively be stabilized, and finally the car 4 can be set in the non-contact guide state.

Like the fourth embodiment, when the first control gain and the second control gain are switched, the gain may be linearly varied during a predetermined transition time period that is needed, or the gain may be smoothly varied via a low-pass filter. Thereby, the car 4 can smoothly be guided.

As has been described above, also by providing a plurality of different control gains with respect to the movement axes and switching them in accordance with positional displacements, the maximum value of the electric current that is needed for the non-contact guide control can be reduced, like the first embodiment, and the power supply capacity of the guide apparatus can be made less than in the prior art.

In each of the above-described embodiments, the zero-power control is executed in the guide apparatus including the permanent magnet 9 in the magnetic unit 6. When the zero-power control is executed, the excitation current relating to the movement axis, with respect to stabilization is effected and transition occurs to the non-contact guide state, decreases to zero. Thus, by successively switching the control for each movement axis, the maximum current can effectively be reduced.

As regards the guide apparatus which does not include the permanent magnet 9 in the magnet unit 6, the above-described method is used in the case where a large current is needed at the time of staring the non-contact guide and the guide is performed with a relatively small current at the time of stable guiding. Thereby, the maximum current can be reduced as a whole.

In the fourth and fifth embodiments, the second gains are provided with respect to all control gains for the respective control axes. However, there is no need to provide the second gains with respect to all control gains. The second gains may be provided with respect to only some of the control gains.

In each of the above-described embodiments, the movement axes are divided into a set of the x and θ movement axes and a set of the y, ξ and ϕ movement axes. However, the combination and the number of combinations are not limited, and arbitrary combinations of axes are possible. In addition, the control may be separated into a greater number of stages, and the axes for guiding may be successively changed.

In summary, the present invention is not limited directly to the above-described embodiments. In practice, the structural elements can be modified and embodied without departing from the spirit of the invention. Various modes can be made by properly combining the structural elements disclosed in the embodiments. For example, some structural elements may be omitted from all the structural elements disclosed in the embodiments. Furthermore, structural elements in different embodiments may properly be combined.

According to the present invention, the maximum power that is needed at the time of the start of guide can be reduced, and the car can be non-contactly run with a small power supply capacity.

What is claimed is:

1. A non-contact running type elevator comprising:

a guide rail which is laid in an up-and-down direction in an elevation path;

a car which ascends and descends along the guide rail;

a guide apparatus which is disposed on a part of the car, which is opposed to the guide rail, the guide apparatus levitating the car from the guide rail by an effect of magnetic force, and non-contactly running and guiding the car; and a control device which controls the guide apparatus in a manner to generate magnetic force with respect to at least two movement axes of the car, the control device executing control for only some of the movement axes at a time of start of guide, and then executing control for the other movement axes after passing of a predetermined time from the start of the guide.

2. A non-contact running type elevator comprising:

a guide rail which is laid in an up-and-down direction in an elevation path;

a car which ascends and descends along the guide rail;

a guide apparatus which is disposed on a part of the car, which is opposed to the guide rail, the guide apparatus levitating the car from the guide rail by an effect of magnetic force, and non-contactly running and guiding the car; and a control device which controls the guide apparatus in a manner to generate magnetic force with respect to at least two movement axes of the car, the control device having control gains which are set for the respective movement axes, executing control, with respect to a specified one of the movement axes, with control gains for generating the magnetic force that is necessary for guiding from beginning of the guiding, executing control, with respect to the other movement axes, with control gains lower than the control gains for generating the magnetic force that is necessary for guiding from beginning of the guiding, and executing control with a predetermined control gain with respect to each of the movement axes after passing of a predetermined time from the beginning of the guiding.

3. The non-contact running type elevator according to claim 2, wherein the control device has gain coefficients for adjusting values of the control gains relating to the respective movement axes, and the control device varies, at a time of beginning of guiding, the gain coefficients of some or all of the control gains of the movement axes, and executes control by setting the gain coefficients of the control gains of the respective movement axes at predetermined values after passing of a predetermined time.

4. The non-contact running type elevator according to claim 3, wherein the control device makes, at the time of the beginning of guiding, the gain coefficient of a specified one of the movement axes greater than the gain coefficients of the other movement axes, and decreases a relative difference between the gain coefficient of the specified movement axis and the gain coefficients of the other movement axes.

5. A non-contact running type elevator comprising:

a guide rail which is laid in an up-and-down direction in an elevation path;

a car which ascends and descends along the guide rail;

a guide apparatus which is disposed on a part of the car, which is opposed to the guide rail, the guide apparatus levitating the car from the guide rail by an effect of magnetic force, and non-contactly running and guiding the car; and a control device which controls the guide apparatus in a manner to generate magnetic force with respect to at least two movement axes of the car, the control device having control gains which are set for the respective movement axes, executing control with control gains for guiding in a normal state when guide positions relating to the respective movement axes are within a predetermined range, and executing control with control gains which are different from the control gains for guiding in the normal state with respect to some or all of the movement axes when the guide positions are out of the predetermined range.

6. The non-contact running type elevator according to claim 5, wherein the control device has gain coefficients for adjusting values of the control gains relating to the respective movement axes, and the control device executes control by setting the gain coefficients at predetermined values when the guide positions relating to the respective movement axes are within the predetermined range, and by varying the gain coefficients of some or all of the movement axes when the guide positions are out of the predetermined range.

7. The non-contact running type elevator according to claim 6, wherein of the gain coefficients for the respective control gains, the gain coefficient relating to at least one of the movement axes is different from the other gain coefficients.

8. The non-contact running type elevator according to claim 3, wherein when the control device varies a certain gain coefficient to another gain coefficient, the control device provides a transition time period and gradually varies the certain gain coefficient during the transition time period.

9. The non-contact running type elevator according to claim 6, wherein when the control device varies a certain gain coefficient to another gain coefficient, the control device provides a transition time period and gradually varies the certain gain coefficient during the transition time period.

10. The non-contact running type elevator according to claim 8, wherein the control device linearly varies a certain gain coefficient to another gain coefficient during the transition time period.

11. The non-contact running type elevator according to claim 9, wherein the control device linearly varies a certain gain coefficient to another gain coefficient during the transition time period.

12. The non-contact running type elevator according to claim 8, wherein the control device varies a certain gain coefficient to another gain coefficient via a low-pass filter during the transition time period.

13. The non-contact running type elevator according to claim 9, wherein the control device varies a certain gain coefficient to another gain coefficient via a low-pass filter during the transition time period.

14. A non-contact running type elevator comprising:

a guide rail which is laid in an up-and-down direction in an elevation path;

a car which ascends and descends along the guide rail;

a guide apparatus which is disposed on a part of the car, which is opposed to the guide rail, the guide apparatus levitating the car from the guide rail by an effect of magnetic force, and non-contactly running and guiding the car; and a control device which controls the guide apparatus in a manner to generate magnetic force with respect to at least two movement axes of the car, the control device having at least two kinds of control gains which are set for the respective movement axes, and executing control by switching the control gains in accordance with a state of each of the movement axes.

15. The non-contact running type elevator according to claim 14, wherein the control device has first control gains and second control gains which are set for the respective movement axes, executes control, at a time of beginning of guiding, by using the second control gains with respect to some or all of the movement axes, and executes control by using the first control gains with respect to all of the movement axes after passing of a predetermined time.

16. The non-contact running type elevator according to claim 14, wherein the control device has first control gains and second control gains which are set for the respective movement axes, executes control by using the first control gains when guide positions relating to the respective movement axes are within a predetermined range, and executes control by using the second control gains with respect to some or all of the movement axes when the guide positions relating to the respective movement axes are out of the predetermined range.

17. The non-contact running type elevator according to claim 15, wherein at least one of the second control gains is set to be greater than the first control gains.

18. The non-contact running type elevator according to claim 16, wherein at least one of the second control gains is set to be greater than the first control gains.

19. The non-contact running type elevator according to claim 14, wherein when the control device varies a certain control gain to another control gain, the control device provides a transition time period and gradually varies the certain control gain during the transition time period.

20. The non-contact running type elevator according to claim 19, wherein the control device linearly varies a certain control gain to another control gain during the transition time period.

21. The non-contact running type elevator according to claim 19, wherein the control device varies a certain control gain to another control gain via a low-pass filter during the transition time period.

22. The non-contact running type elevator according to claim 1, wherein the guide apparatus comprises a magnet unit including an electromagnet, and the control device controls a current which excites the electromagnet, thereby running and guiding the car without putting the car in contact with the guide rail.

23. The non-contact running type elevator according to claim 1, wherein the guide apparatus includes a magnet unit including an electromagnet and a permanent magnet, and the control device controls a current which excites the electromagnet, thereby running and guiding the car without putting the car in contact with the guide rail.

24. The non-contact running type elevator according to claim 23, wherein the control device runs and guides the car without putting the car in contact with the guide rail, and decreases a steady value of the current, which excites the electromagnet, to zero, regardless of presence/absence of external force acting on the car.

* * * * *